US006353980B1

(12) United States Patent
Sprenger et al.

(10) Patent No.: US 6,353,980 B1
(45) Date of Patent: Mar. 12, 2002

(54) SPUR WITH A U-SHAPED HEEL SECTION AND A NECK

(75) Inventors: Peter Sprenger; Valentin Völlmecke; Heinz Baumann, all of D-Iserlohn (DE)

(73) Assignee: Herm. Sprenger GmbH & Co., KG (DE)

( * ) Notice: Subject to any disclaimer, the term of this patent is extended or adjusted under 35 U.S.C. 154(b) by 0 days.

(21) Appl. No.: 09/442,621

(22) Filed: Nov. 17, 1999

(30) Foreign Application Priority Data

Nov. 27, 1998 (DE) ..... 298 21 215

(51) Int. Cl.[7] ..... A44B 11/25; A43C 17/02

(52) U.S. Cl. ..... 24/200; 24/164; 24/182; 54/83.1

(58) Field of Search ..... 24/220, 164, 182; 224/257, 258; 54/83.1

(56) References Cited

U.S. PATENT DOCUMENTS

| | | | | | |
|---|---|---|---|---|---|
| 276,269 | A | * | 4/1883 | Neider | 24/182 |
| 466,330 | A | * | 1/1892 | Dare | 24/182 |
| 518,833 | A | * | 4/1894 | Cooper | 24/200 |
| 1,081,054 | A | * | 12/1913 | McCormick | 24/164 |
| 3,858,279 | A | * | 1/1975 | Brattstrom | 24/200 |
| 5,394,677 | A | * | 3/1995 | Van Scoyk | 54/83.1 |
| 5,450,712 | A | * | 9/1995 | Van Scoyk | 54/83.1 |

* cited by examiner

*Primary Examiner*—Victor N. Sakran
(74) *Attorney, Agent, or Firm*—Akerman Senterfitt

(57) ABSTRACT

A spur comprises a U-shaped heel section and a neck. The heel section shows a basis, at which the neck is fitted to and which heel section shows two lateral legs starting from the basis. Also, the heel section is cut to size out of a sheet metal and is bent in a U-shape. The heel section is also embossed so that the legs have a profile deviating from a rectangular cross-section shape of the blank.

11 Claims, 1 Drawing Sheet

SPUR WITH A U-SHAPED HEEL SECTION AND A NECK

FIELD OF THE INVENTION

The invention relates to a spur, which is essentially constructed out of a U-shaped heel section and out of a neck, in the case of which the heel section shows a) a basis at which the neck is fitted to and which shows two lateral legs and b) which is cut to size out of sheet metal and which is bent in U-shape.

BACKGROUND OF THE INVENTION

The heel sections of spurs are often produced in the casting method, in most cases the spur is then also produced at the same time in one piece during casting. Cast heel sections or spurs have a responsive, rounded outer surface, which not only signals a superiority, but which also optically presents a good picture. Cast spurs usually have an irregular cross-section, in the middle area of the legs they are thicker than at the upper or lower edge of the leg. This material thickness leads to a noticeable firmness and stiffness of the U-shaped heel section. However, cast spurs are relatively expensive in their production, they require, with regards to the device as well as also mechanically, a relative large input for their production.

In the case of the spur of the above-mentioned kind, a production method has been selected, which is, compared to this, clearly more cost effective. Initially an elongated blank is punched out of metal, then bent, so that the U-shaped heel section is formed, finally the neck is attached to the outside of the basis of the heel section. Such spurs, however, have a flat cross-section of their legs. This has consequential effects on the optic, on account of the flat legs of their heel sections they can be clearly distinguished from cast spurs. Their outer surface is smooth and even. They are also not as resistant against a warping as cast spurs.

SUMMARY OF THE INVENTION

This is where the invention starts. It is the task of the invention to further develop the spurs of the above mentioned kind in such a way, that by means of simple, additional processing steps the spurs receive a look, that differentiates it as little as possible from cast spurs, whereby the simple and cost effective manufacturing method of the above-mentioned kind should be maintained.

Starting from the spur of the above-mentioned kind, this task is solved in such a way, that the heel section is embossed after punching out the blank, so that the legs show an outward protuberant bulging at their outer surface.

In the case of this spur the fact, that the spur is produced out of sheet metal, is only very difficult to recognise from the outside, especially when it is worn at a riding boot. The lateral legs have, on their outer surface, a protuberant bulging towards the outside, which should and can be formed and constructed in exactly the same way as it is formed in the case of cast spurs. If the spur, in accordance with the invention, is put onto a riding boot, one does not recognise the bulging, inevitably necessary at the inside area of the heel section.

Through the alteration or deformation of the cross section of the heel section, in accordance with the invention, particularly of its two legs, also an increase of the stiffness is achieved. In the interaction with the chosen sheet metal and its material strength, a stiffness of the heel section is achieved, which has proven to be very suitable in practical use. This can indeed still be bent, i.e. it can be adjusted to the boot shaft, but such a bending demands a much larger force and the occasionally criticised softness against buckling of the spur of the above-mentioned kind, is now no longer given. In practice it shows, that the spurs, in accordance with the invention, can specifically be bent on account of its stiffness, but then, in the practical use, maintain the once conferred bend. This is favourable.

In the case of the production the blank is thus still produced out of sheet metal, which is relatively elongated. At its two free ends is has mounting material for the spur, for example strap eyelets. In the area of the strap eyelets and thus in the area of the free ends, the blank preferably has widenings or enlargement areas to make space for the strap eyelets.

In the next step of the production, this blank is embossed by embossing at least one bead on the inside surface of the spur. Only afterwards the spur is bent into its U-shape.

The bead can now stretch in one piece, starting from the enlargement area at one free end up to the enlargement area at the other free end. But preferably it is also possible to embody its own bead in each side, which ends in the area of the basis, so that the basis is not embossed, i.e. that it maintains its rectangular shaped cross-section. This has the advantage that the outer surface of the basis stays linear, so that the neck can there be joined better.

Usually these enlargement or widening areas, in which the strap eyelets are, are not embossed. However, it is quite advantageous to let the bead also run through up to these areas, which, in the case of two strap eyelets, lying next to each other, offer the advantage, that a medium crosspiece between the two strap eyelets is embossed outward, which on the other hand makes a threading of a strap easier.

During the embossing process, the edges, normally sharp during cutting, are rounded off. Thus, additional process steps for rounding off the edges, are saved. Nevertheless, it is not ruled out to treat the edges also further, for example through grinding or polishing.

It has proven to be advantageous to provide, preferentially at the unembossed basis, an outward protuberant welding hump, which has the task, to fit a neck by projection welding.

The formerly construction of the bulging at the outer surface, at least of the legs, is at random. The bulging can also be constructed differently at different positions of the legs. The bulging is thus constructed that an overall picture as aesthetic as possible is achieved. In general the bulging is thus as smooth and flowing as possible, which does however not exclude, that special local characteristics are distinguished, such as for example projections, stars etc., this in particular for riders, who appreciate such prominent characteristics, for example western riders.

As ever, the blank for the heel section has the form, which determines extensively the later look of the spur. Thus it is possible, that in connection to the enlargement areas, in which the strap eyelets are, the legs have a relative small height and increase to the rear, towards the basis, in their height. However, the blank can also have any form, for example jagged edges etc.

BRIEF DESCRIPTION OF THE DRAWINGS

Further advantages and characteristics of the invention result out of the remaining claims as well as the now following description of an embodiment of the invention, not to be understood as limiting, which is explained in more detail with reference to the drawing. This shows:

DETAILED DESCRIPTION OF THE PREFERRED EMBODIMENTS

Figure 1:
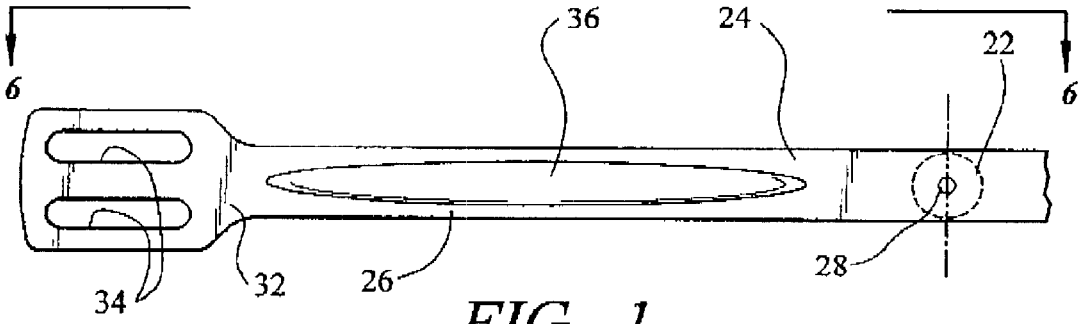
FIG. 1: a top view of the inside surface of a blank of the heel section, after embossing, shown is only a little more than half of the folding symmetrical blank.

The spur has, in the already known kind, a U-shaped heel section 20 and a neck 22. The latter can be releasable or permanently connected to the heel section 20. The heel section 20 has a relatively short basis 24 and two legs 26 starting from this to both sides, which are in the main of identical construction. At the basis 24, the neck 22 is fixed. In a preferred embodiment a hump 28 is provided for this, which projects to the outside, towards the neck 22 to be fixed.

The heel section 20 is produced out of a blank, which is partially illustrated in FIG. 1. It is folding symmetrical to a line of symmetry 30. The area, on which the neck 22 will be fitted later, is indicated in dotted lines.

At the free ends of the elongated blank are the widening or enlargement areas 32, which each are constructed roughly of the shape of a head. In these are two oblong holes 34, running parallel or in an angle to each other, constructed as eyelets for a fixing strap. The enlargement areas 32 belong to the legs 26.

A bead 36 is embossed in the leg 26. Thus the leg 26 has, at its outer surface, an outward protuberant bulging 38. As FIG. 1 shows, each leg 26 has its own bead 36. This starts behind the enlargement area 32 and ends before the basis 24. Thus the basis is not embossed, see FIG. 2, so that the neck 22 can be easily fixed on the basis. Basically, it is also possible to let the bead 36 run on through the basis 24, thus only providing one single bead. In this case the neck 22 must be adjusted to the bulging 38 at its end, with which it sits on the basis 24. The latter is not necessary for a non embossed basis 24.

Figure 2:
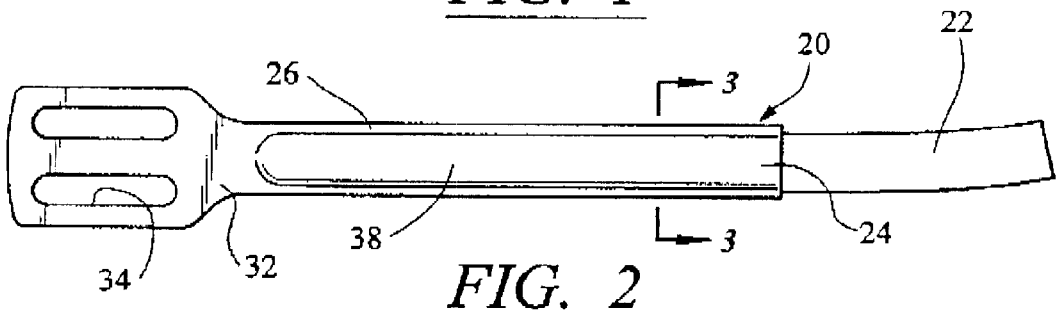
FIG. 2: a side view of the spur in accordance with the invention.

The blank, as illustrated in FIG. 1, is produced through punching out of special sheet steel in a thickness of 2.5 mm. Hereby the oblong holes 34 are also formed. In a further processing step this blank is then embossed by embossing a bead 36 each into the two legs 26, this condition of the blank is shown in FIG. 1. Afterwards the now embossed blank is bent into the U-shape, so that the U-shaped condition according to FIG. 2 is achieved.

Figure 3:
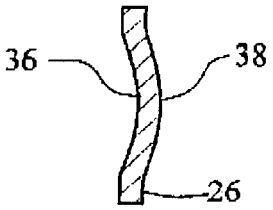
FIG. 3: a section along the line of intersection III—III in FIG. 2.
Figure 4:
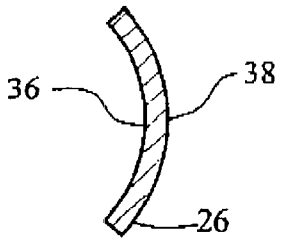
FIG. 4: a different formation for the legs, again seen in the sense of a section along the line of intersection of FIG. 3, FIG. 5: again a different formation for the legs, again seen in the sense of a section along the line of intersection of FIG. 3, FIG. 6: a projection on the blank, according to FIG. 1, onto a narrow surface
Figure 5:
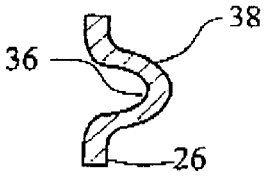

Out of FIGS. 3 to 5 different cross-section shapes of the legs 26 can be seen in the area of the line of intersection III—III. The different cross-section shapes are to prove, that one has a significant influence on the specific design of the bead 36, i.e. one is able to give clearly different shapes, such as, for example, a comparison of FIGS. 3 and 5 shows. In the example of an embodiment, in accordance with FIG. 5, a bead is locally embossed quite deeply, whilst in the example of an embodiment, in accordance with FIG. 4, the bead practically stretches via the complete height of the profile. In the example of the embodiment, in accordance with FIG. 3, the bead does not stretch in its height via the total height of the leg 26, so an embodiment is in hand, which is to be placed between those of FIGS. 4 and 5. On the three illustrated cross-sections the bulging 38 at the outer surface of the sides 26 can be clearly seen. FIG. 4 shows that the edges are rounded off, so that no edgings protrude at all. This can also be embodied in the case of the other cross-section shapes.

Figure 6:
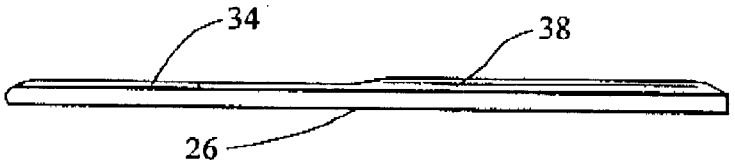

FIG. 6 finally shows an embodiment, in the case of which the embossing along the center line of the blank is passed through up into the area between the two oblong holes 34. Thus the crosspiece, which is between the two oblong holes 34, is pressed outward. In this way the threading of a belt or of a strap is simplified, furthermore the strap lies better, because it is not as strongly curved in the case of passing through the two oblong holes 34.

The complete spur is electro-polished. The embossing takes place in the usual way with an upper die and a matrix. Other processes for the construction of the bead 36 are thus not excluded, the bead can, for example, be also rolled, pressed in etc.

Figure 7:
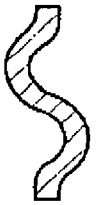
FIG. 7: again an altered construction for the profile of the legs, carried out as sectional drawing, according to the line of intersection III—III in FIG. 2.

FIG. 7 shows a cross-section shapes in the case of a section in accordance with III—III in FIG. 2, but now with a wavelike profile. Other profile shapes, such as W-shaped, S-shaped, C-shaped, U-shaped are possible.

The profile shape, in accordance with FIGS. 3 and 5, can also be realised mirror inverted. Then the bead 36 is on the outer surface and the bulging 38 on the inside surface of the leg 26.

What is claimed is:

1. A spur comprising a U-shaped heel section and a neck, wherein said heel section comprises:

a basis, to which said neck is fitted; and two lateral legs starting from said basis;

wherein the heel section is cut to size out of sheet metal and is bent into said U-shape; and wherein the heel section is embossed so that the legs have a profile deviating from a rectangular cross-section shape of said blank and define a protuberant bulging; and wherein said U-shaped heel section has an outer surface and said protuberant bulging protrudes outwards from said outer surface.

2. Spur according to claim 1, wherein a continuous, elongated bead is embossed into each individual leg, which shows said bulging directed to the outside of said U-shaped heel section.

3. Spur according to claim 1, wherein at those positions, at which the heel section has a bulging towards the outside on its outer surface, a vault is on the inside surfaces.

4. Spur according to claim 1, wherein said basis is not embossed.

5. Spur according to claim 1, wherein said heel section, seen in the cross-section, shows rounded edges.

6. Spur according to claim 1, wherein said basis has an outer surface and at said outer surface of said basis a welding hump is provided for point-welding on said neck.

7. Spur according to claim 1, wherein said heel section is cut to size out of sheet steel, which has a thickness of 1.5–3 mm.

8. Spur according to claim 1, wherein each of said two legs has a free end and a widened area is provided at each said free end of said two legs, in which widened area elongated holes are provided as strap eyelets.

9. Spur according to claim 1, wherein said blank of said heel section is embossed before said blank is bent into said U-shape.

10. Spur according to claim 1, wherein the embossed blank is bent into said U-shaped form.

11. Spur according to claim 1, wherein said U-shaped heel section has in addition to said protuberant bulging protruding outwards from said outer surface a protuberant bulging protruding inwards from said outer surface.

* * * * *